US009279422B2

(12) United States Patent
Tujula et al.

(10) Patent No.: US 9,279,422 B2
(45) Date of Patent: Mar. 8, 2016

(54) EQUIPMENT FOR ROTATING A ROTOR OF A PERISTALTIC PUMP

(75) Inventors: Anssi Tujula, Vainikkala (FI); Markus Rossi, Joutseno (FI)

(73) Assignee: FLOWROX OY, Lappeenranta (FI)

( * ) Notice: Subject to any disclaimer, the term of this patent is extended or adjusted under 35 U.S.C. 154(b) by 0 days.

(21) Appl. No.: 14/391,021

(22) PCT Filed: Apr. 24, 2012

(86) PCT No.: PCT/FI2012/050403

§ 371 (c)(1),
(2), (4) Date: Oct. 7, 2014

(87) PCT Pub. No.: WO2013/160519

PCT Pub. Date: Oct. 31, 2013

(65) Prior Publication Data

US 2015/0064035 A1 Mar. 5, 2015

(51) Int. Cl.

| | |
|---|---|
| ***F04B 43/08*** | (2006.01) |
| ***F04B 45/08*** | (2006.01) |
| ***F04B 43/12*** | (2006.01) |
| ***F04B 9/14*** | (2006.01) |
| ***F04B 35/01*** | (2006.01) |
| ***F04B 49/10*** | (2006.01) |

(52) U.S. Cl.

CPC . *F04B 45/08* (2013.01); *F04B 9/14* (2013.01); *F04B 35/01* (2013.01); *F04B 43/12* (2013.01); *F04B 49/10* (2013.01)

(58) Field of Classification Search

USPC ..... 81/177.1, 177.2, 489, 30

See application file for complete search history.

(56) References Cited

U.S. PATENT DOCUMENTS

| | | | | |
|---|---|---|---|---|
| 2,262,535 | A | 11/1941 | Hogaboom | |
| 3,042,067 | A * | 7/1962 | Hidding | 137/315.07 |
| 4,277,229 | A * | 7/1981 | Pacht | 417/454 |
| 4,398,872 | A * | 8/1983 | Fleenor et al. | 417/360 |
| 4,522,571 | A * | 6/1985 | Little | 417/476 |
| 5,062,775 | A * | 11/1991 | Orth | 417/477.3 |
| 5,588,169 | A * | 12/1996 | Chuang | 7/138 |
| 5,630,711 | A * | 5/1997 | Luedtke et al. | 417/477.9 |
| 7,726,956 | B2 | 6/2010 | Riihimaki | |
| 2011/0084049 | A1* | 4/2011 | Nash | 219/121.48 |
| 2011/0232985 | A1* | 9/2011 | Lee | 180/297 |

OTHER PUBLICATIONS

Dec. 18, 2012 International Search Report issued in International Application No. PCT/FI2012/050403.

Aug. 29, 2014 International Preliminary Report on Patentability issued in International Application No. PCT/FI2012/050403.

* cited by examiner

*Primary Examiner* — Charles Freay

(74) *Attorney, Agent, or Firm* — Oliff PLC

(57) ABSTRACT

The invention concerns a peristaltic hose pump and an equipment for the peristaltic hose pump. The pump includes a rotor configured to compress a hose/tube being positioned on the pump cavity inner perimeter. The rotor is coupled to a one end of a crankshaft of the pump body and the pump includes a device to receive an equipment for rotating the rotor manually. The equipment for rotating the rotor includes a connection point that is configured to connect the equipment to the pump. The equipment includes also weight configured to act as a counterbalance to the rotor in order to maintain the position of the rotor.

7 Claims, 9 Drawing Sheets

EQUIPMENT FOR ROTATING A ROTOR OF A PERISTALTIC PUMP

CROSS-REFERENCE TO RELATED APPLICATION

This application is a National Phase Application of International Application No. PCT/FI2012/050403, filed Apr. 24, 2012.

FIELD OF THE INVENTION

This invention concerns generally a peristaltic hose pump, and particularly to an equipment for rotating a rotor of the pump for example in a situations where the hose needs to be removed or changed.

BACKGROUND OF THE INVENTION

Positive displacement pumps, in which peristaltic pumps form a subclass, are employed for pumping problematic substances in particular, such as abrasive, corrosive, slurried or high-viscosity liquids and liquid-suspended solids. Peristaltic pumps are also preferred when pumping as a primary function must be complemented with accurate metering, high hygienic standard and leakproofness. Peristaltic pumps are used widely e.g. in the manufacture of foodstuffs, drugs, oil and chemical products. In heavy industries, peristaltic pumps serve to pump, inter alia, such materials as liquids and ore/mineral suspensions.

To operate properly, a peristaltic pump must be capable of forcing a volume of a fluid medium to move along a hose/tube by way of peristaltically compressing the hose from end to end during one turn of the pump rotor while simultaneously the next fluid volume is already filling the hose. Conventionally, this pumping sequence is implemented by rotating a nonrotary shoe or pressing roller, whereby the hose is subjected to progressive compression in the nip between the shoe/roller and the peripheral wall of the pump head. Furthermore, the hose/tube/tubing is selected to be sufficiently elastic and reinforces such that the hose resumes its circular profile immediately after the compression thereby creating a vacuum in its lumen thus including the entry of the next volume of the fluid medium into the hose.

Publication U.S. Pat. No. 7,726,956 discloses an example of a peristaltic hose pump. A peristaltic pump according to the publication is shown in FIG. 1. The pump comprises a pump body 1, a hose 2 and a rotor 3. The rotor 3 is mounted freely rotatable on bearings mounted onto an eccentric adjustment bushing 5. In use, the rotor 3 rotates in the pump cavity and compresses the hose 2 in said pump cavity by rolling over the hose surface thus propelling the bulk of fluid medium contained in the hose 2. With the rotary progressive motion of the rotor 3 and the hose recovering its circular profile immediately after the point of rotor compression, the hose 2 creates a vacuum that causes the hose 2 to become refilled with the fluid medium being pumped. The adjustment mechanism serves to adjust the gap between the rotor outer surface and the pump cavity inner periphery that determines the compressive force imposed on the hose. The hose 2 is located within the housing of the peristaltic pump, and the hose ends are placed to the feed-through openings 6, 7.

FIG. 2 shows a cross-sectional sideview of the peristaltic pump shown in FIG. 1. FIG. 2 shows the rotor 3 and the adjustment bushing 5. In addition, FIG. 2 shows also a crankshaft pin 10, onto which the adjustment bushing 5 and the rotor 3 is mounted.

FIG. 3 shows an example of the hose 30 that is inserted within the peristaltic pump. The hose ends 31, 32 are placed to the feed-through openings (see FIG. 1: 6,7) of the peristaltic pump, and the loop of the hose is brought over the rotor (FIG. 1: 3).

SUMMARY OF THE INVENTION

In order to remove, change or insert a hose to the peristaltic pump, the rotor needs to be manually rotated. The present invention relates to an equipment by means of which the rotor may be safely rotated. The equipment is also suitable to be used with different kinds of peristaltic hose pumps.

According to a first aspect, a peristaltic pump is provided comprising a rotor configured to compress a hose/tube being positioned on a pump cavity inner perimeter, said rotor being coupled to a one end of a crankshaft of a pump body, wherein the pump comprises means to receive an equipment for rotating the rotor manually. The equipment for rotating the rotor comprises a connection point configured to connect the equipment to the pump and a weight configured to act as a counterbalance to said rotor in order to maintain the position of the rotor.

According to a second aspect, an equipment is provided for rotating a rotor of a peristaltic hose pump, the equipment comprising a connection point configured to connect the equipment to the peristaltic pump and a weight configured to act as a counterbalance to said rotor in order to maintain the position of the rotor.

According to an embodiment, the equipment is connected either to an other end of the crankshaft of the pump or to an axel of an operating device of the pump.

According to an embodiment the equipment comprises a pin for tightening the connection between the connection point and the end of the crankshaft of the peristaltic pump.

According to an embodiment the connection point with the pin are configured to receive and tighten different kind of crankshaft ends having a diameter less than the diameter of the connection point.

According to an embodiment the connection point is an opening.

According to an embodiment the equipment comprises a handle.

DESCRIPTION OF THE DRAWINGS

For a more complete understanding of example embodiments of the present invention, reference is now made to the following descriptions taken in connection with the accompanying drawings in which.

DETAILED DESCRIPTION OF THE INVENTION

Figure 4:
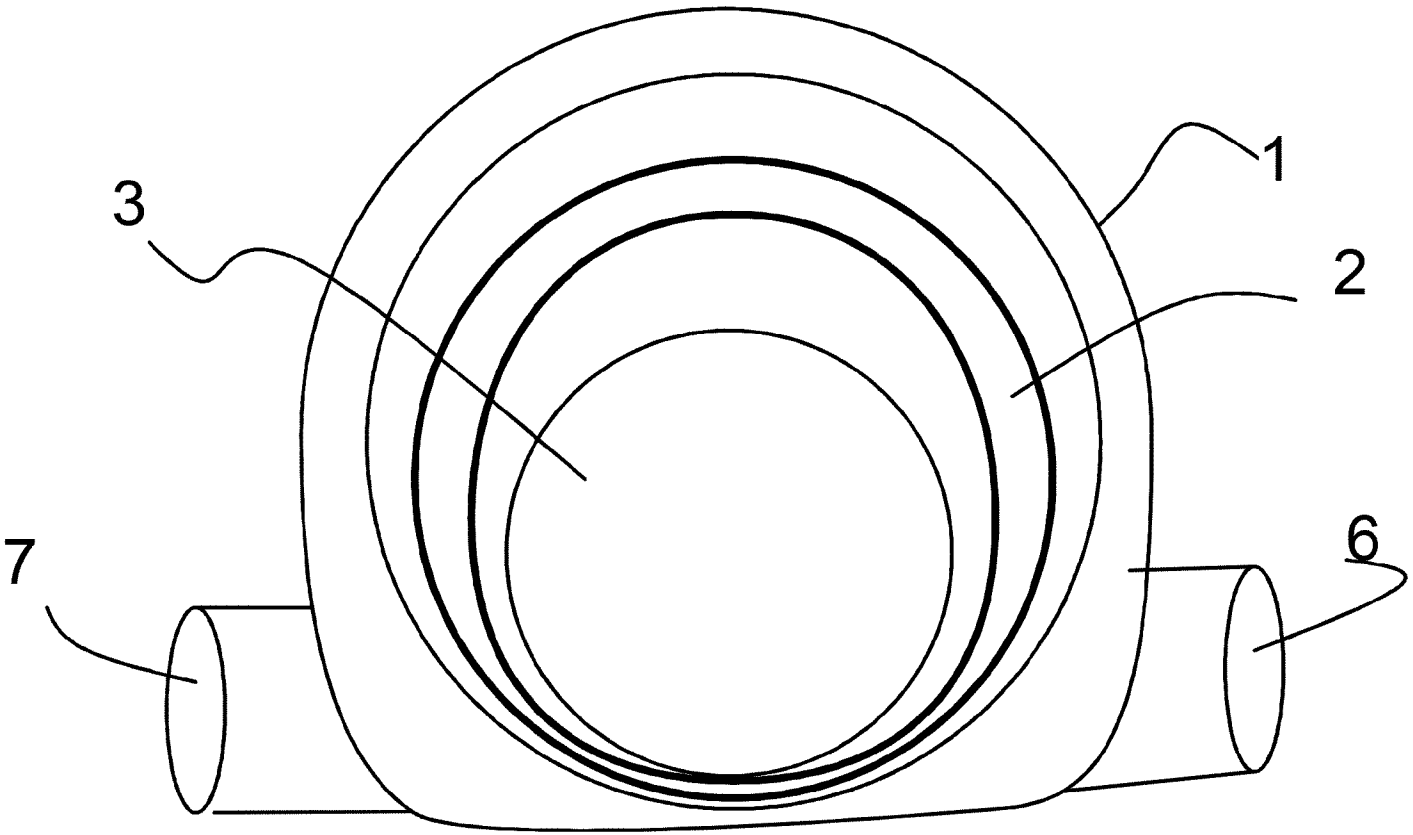
FIG. 4 PRIOR ART
FIG. 4 shows a simplified illustration of a peristaltic pump having a rotor in a lower position.

In the peristaltic hose pumps, the hose needs to be changed or removed for example, when the hose is worn or when the pump needs to be cleaned. In order to take the hose 2 out from the housing of the peristaltic pump 1, the rotor 3 is preferably stopped at or rotated to e.g. a lower position (see FIG. 4 illustrating a very simplified manner a structure of a peristaltic pump 1 where the rotor 3 is at lower position). A maintenance window and front cover (not shown in figures) of the peristaltic pump are then opened and the hose compression may be released. When the rotor 3 is at lower position, the upper part of the hose loop 2 can be removed from the housing.

Figure 1:
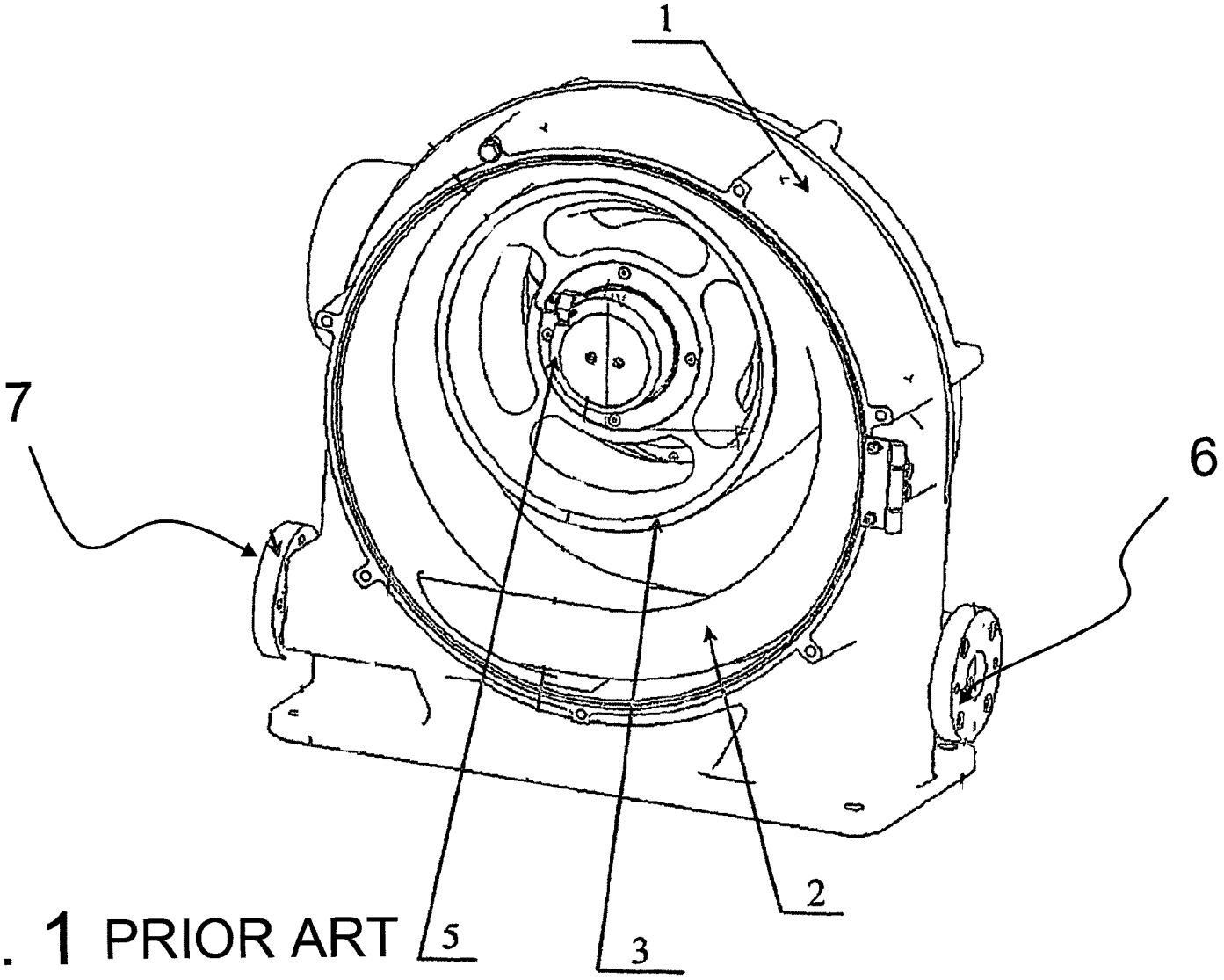
FIG. 1 PRIOR ART
FIG. 1 illustrates an example of a peristaltic hose pump.
Figure 2:
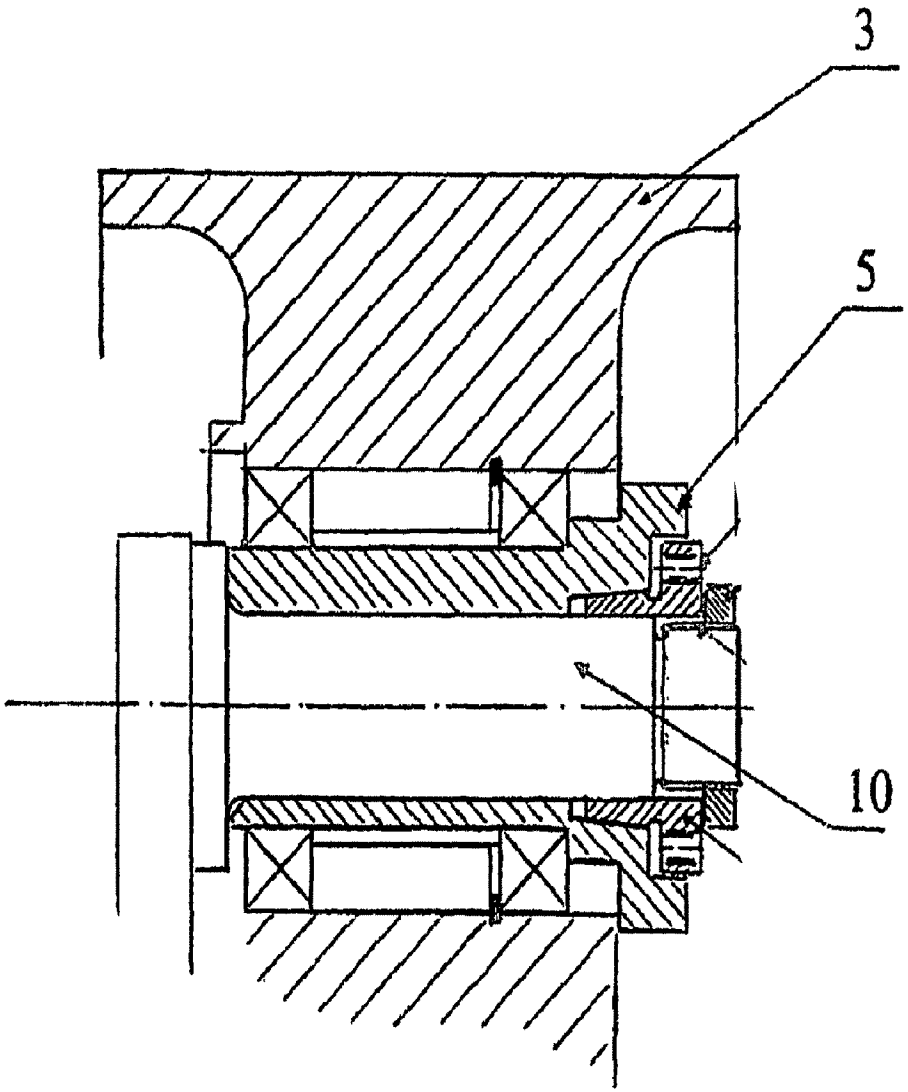
FIG. 2 PRIOR ART
FIG. 2 illustrates a cross-sectional sideview of a peristaltic hose pump.
Figure 3:
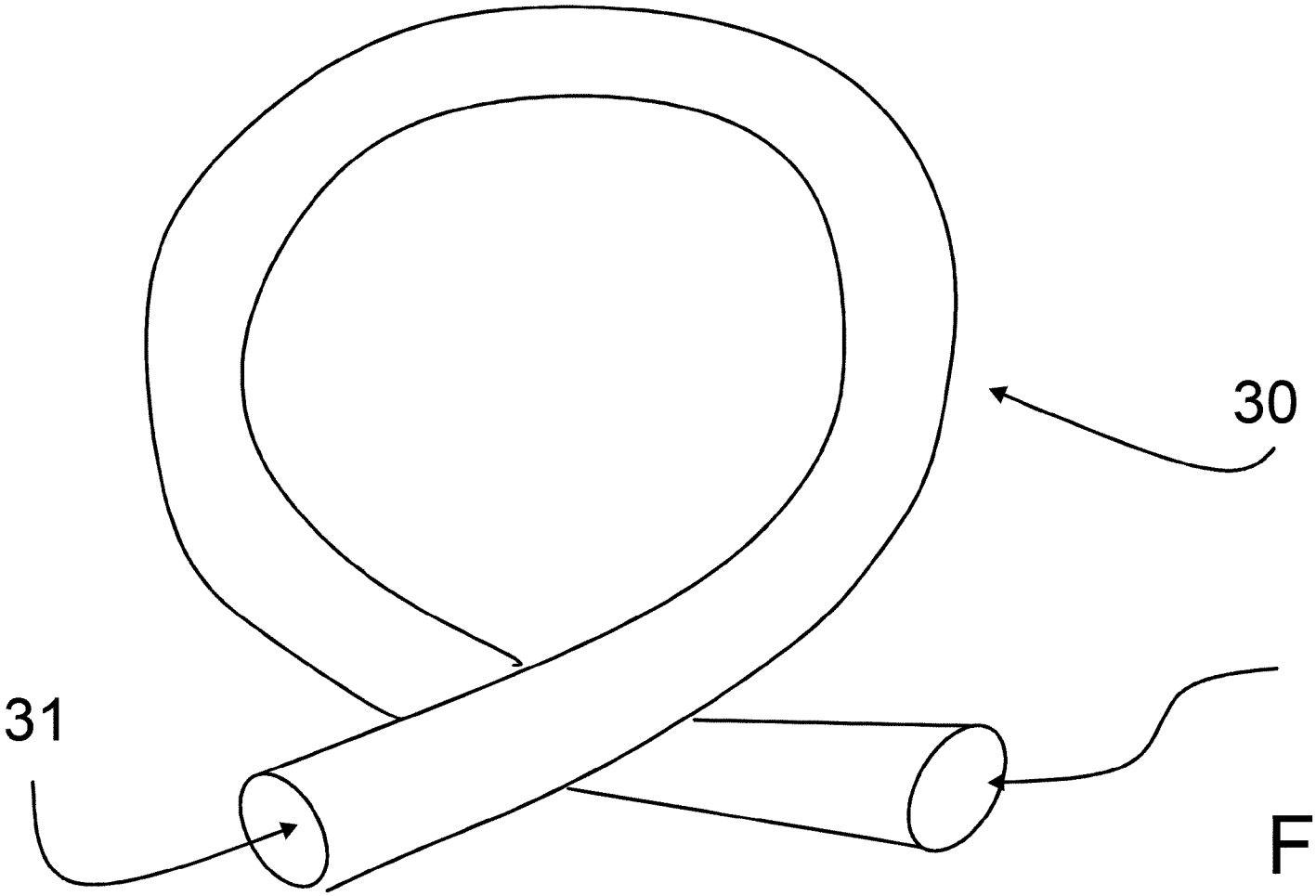
FIG. 3 PRIOR ART
FIG. 3 illustrates an example of a hose to be fitted in the peristaltic hose pump.
Figure 5:
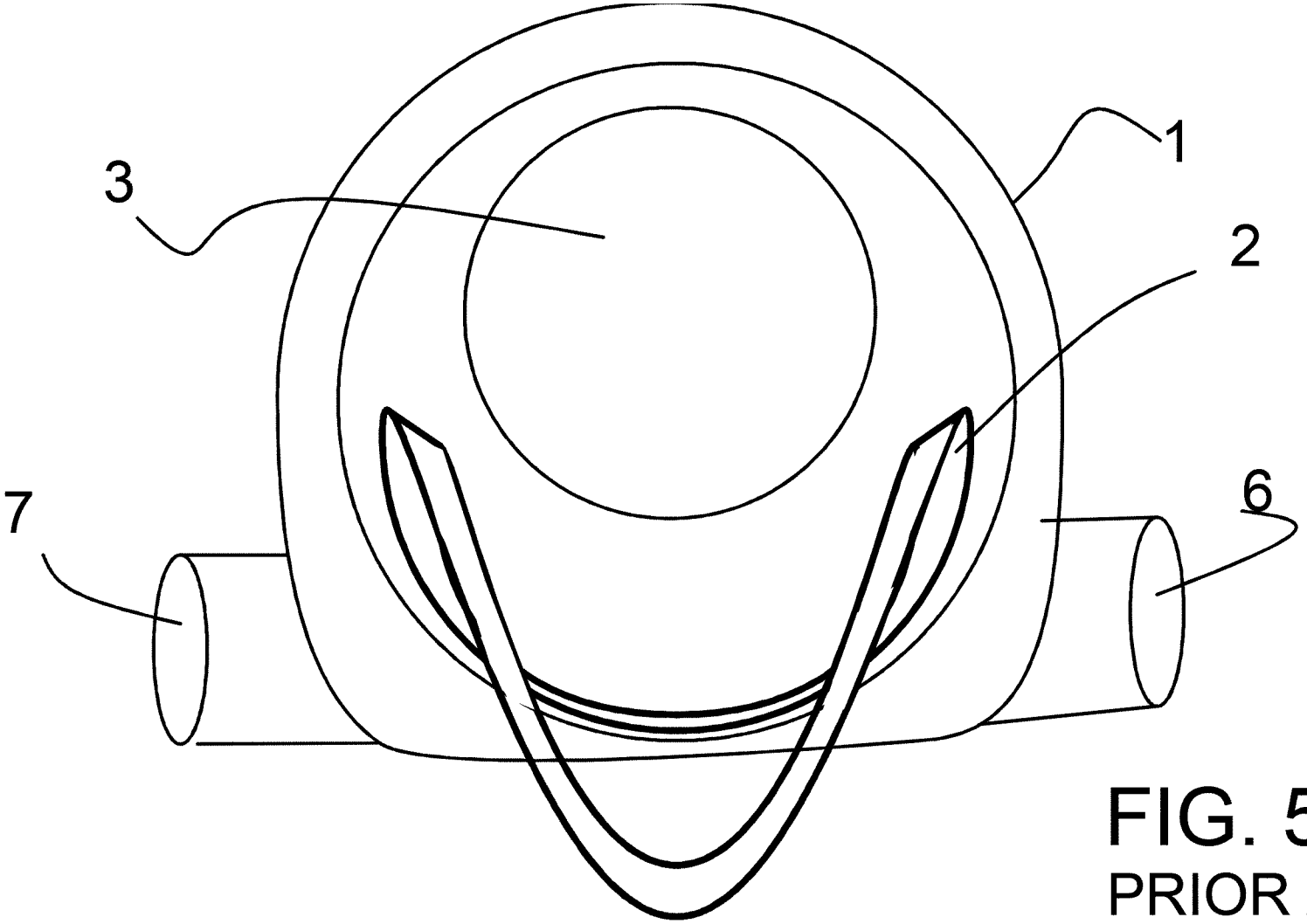
FIG. 5 PRIOR ART
FIG. 5 shows a simplified illustration of a peristaltic pump having a rotor in an upper position.

In order to remove the lower part of the hose loop 2, the rotor 3 needs to be rotated to upper position in the housing (see FIG. 5 illustrating a very simplified manner a structure of peristaltic pump 1 where the rotor 3 is at upper position). Typically this is done by attaching a wheel to a crankshaft (FIG. 2: 10) that rotates the rotor. However, for keeping the rotor in a certain position, a motor with a brake needs to be used for locking the wheel. Otherwise, because of the weight of the rotor, the rotor may rotate freely to the lower position in the housing thus causing a dangerous situation for anyone operating with the hose below the rotor.

Figure 6:
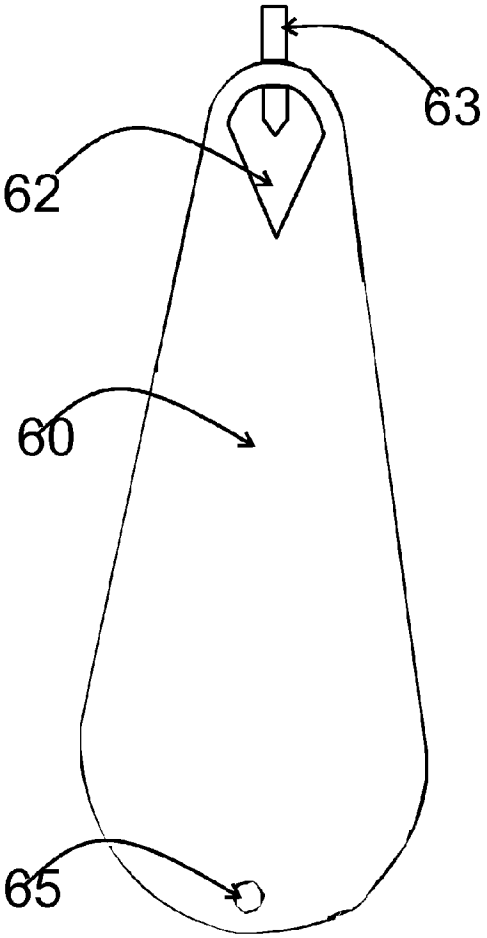
FIG. 6 illustrates an example of an equipment to be used for rotating a rotor.

The present invention is targeted to an equipment (i.e. a crank cam 60 shown in FIG. 6) for rotating a rotor when a hose needs to be removed from the peristaltic pump. The crank cam 60 comprises a connection point 62 from which the crank cam can be placed to such an end of the crankshaft that does not comprise the rotor. The connection point 62 is preferably an opening but it can be a cavity as well. The crank cam 60 comprises also a pin 63 that is used for tightening the crank cam to the crankshaft end. The crank cam 60 also comprises a place 65 for a handle (FIG. 9: 70), by means of which the crank cam 60 can be manually rotated. The crank cam 60 is safer to use than a wheel, because it maintains the rotor in any position without any brakes or locks. The appearance of the crank cam 60 is selected so that it can act as a weight to counterbalance the rotor which is at the other end of the crankshaft. This means that when the pump (and therefore also the rotor) is stopped in such a phase where the rotor is positioned on the horizontal axel of the pump housing, the crank cam 60 is able to keep the rotor on its position.

As said, when the rotor is in the upper position (FIG. 4), the lower part of the hose 3 can be released. In order to do that, connection flanges and split bushings are removed from hose feed-through openings. After this, the hose can be removed. A new hose can be inserted to the feed-through openings 6, 7, and split bushings and connection flanges are reattached. Again, a rotor 3 needs to be rotated with a crank cam 60 in order to have the upper part of the hose loop inserted into the cavity of the peristaltic pump. When the complete hose loop is in the housing, the rotor 3 may be returned into top position by rotating the crank cam. The connection flanges are then tightened, the hose compression can be tightened, the locking cover is shut and the front cover is closed. Then the rotor can be rotated to bottom position and the rotor may be lubricated and rotor bearings can be greased. For finishing the hose change, the maintenance window needs to be closed, and the crank cam is removed.

Figure 7:
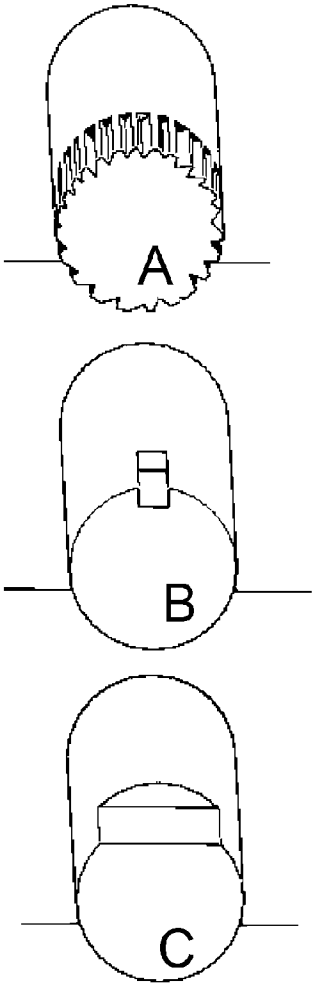
FIG. 7 illustrates examples of axel ends of a crank shaft.

The crank cam can be connected to the crank shaft (FIG. 2: 10) of the pump, to the other end than where the rotor is being located. It is also possible that the crank cam is connected to the shaft of the gear motor, i.e. electric motor that is configured to rotate the pump during pump's operation. This means that the crank cam can also be used for rotating the pump by means of such operating device. The connection point (FIG. 6: 62) of the crank cam is configured such that it is suitable for different types of crankshaft ends. The crank shafts of different kind of pumps vary e.g. by diameter, by grooves but also the crankshaft ends may be knurled or cut. FIG. 7 illustrates three non-limiting examples of the crankshaft ends A-C. The crank cam of the present solution is suitable for such axel ends.

Figures 8A, 8B, 8C:
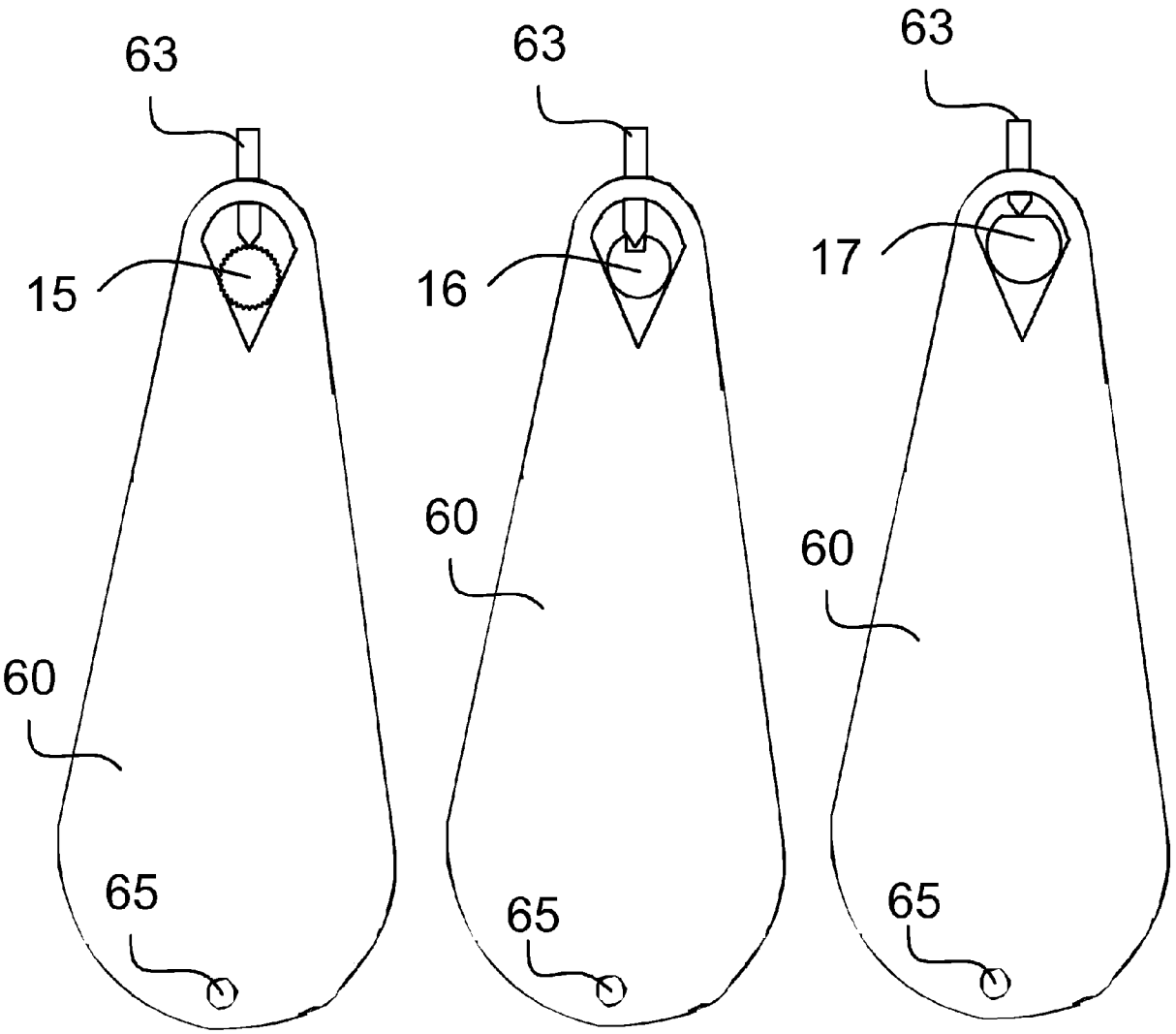
FIGS. 8A-8C illustrate examples of the equipment being connected to different kinds of axel ends.
Figure 9:
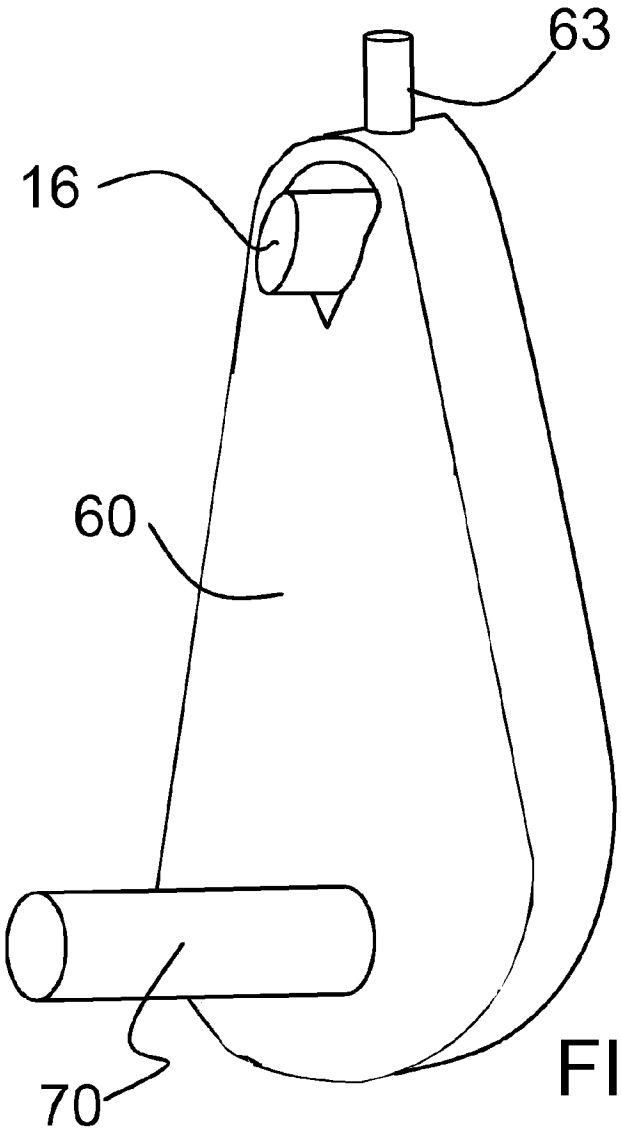
FIG. 9 illustrates an example of a crank cam.
Figure 10:
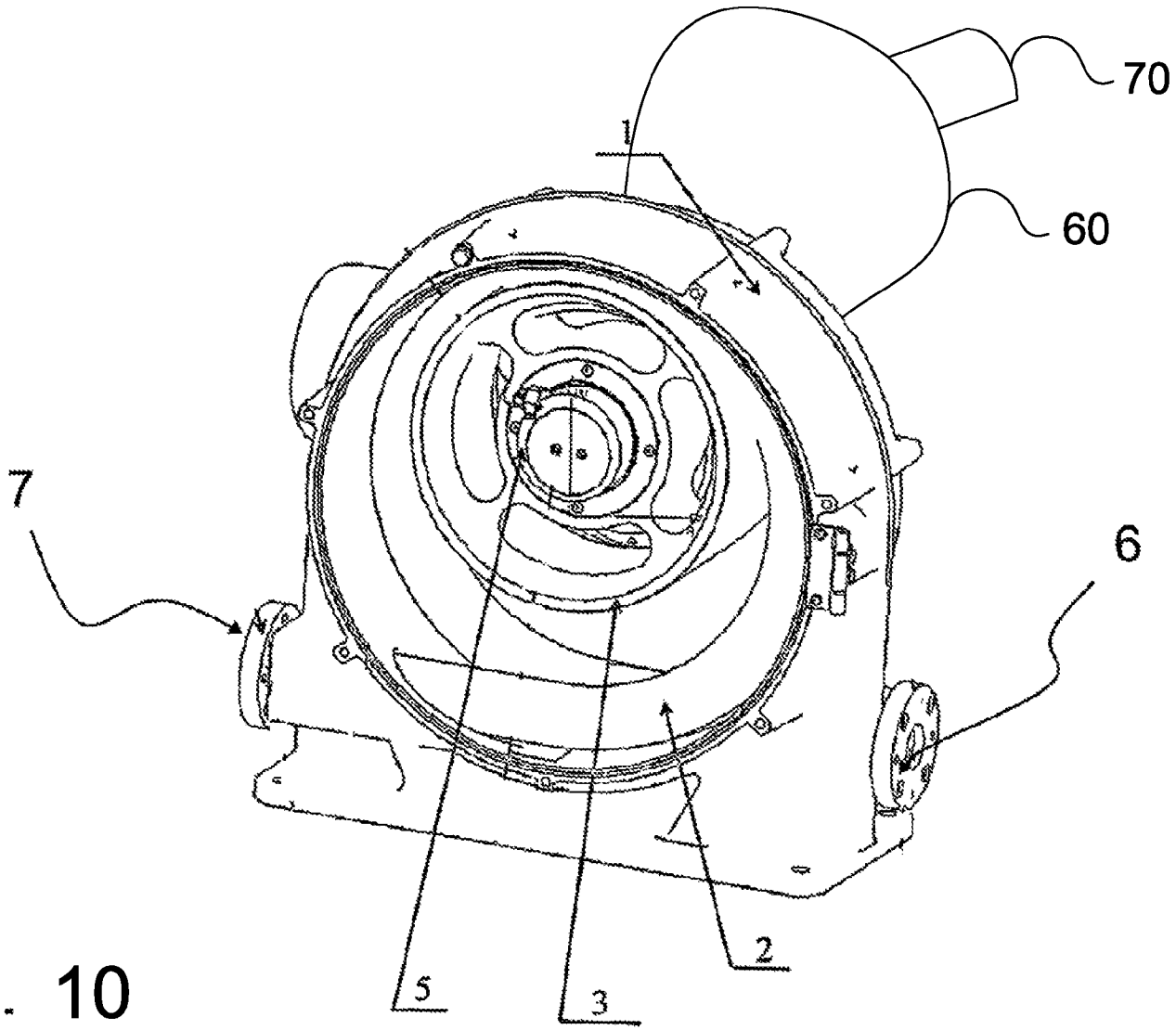
FIG. 10 illustrates an example of the equipment being connected to a peristaltic pump.

FIGS. 8A-8C illustrate how the crank cam 60 is attached to different types of crankshaft ends (15, 16, 17) by means of the pin 63. The opening (FIG. 6: 62) of the crank cam 60 is formed in such a manner that axel ends of different sizes can be fitted to the opening. The pin 63, on the other hand, tightens the axel end (15, 16, 17) in the opening. In order to use the crank cam 60 for rotating the rotor, a handle needs to be placed onto the place 65. FIG. 9 shows a handle 70 for crank cam 60.

The present invention concerns a rotatable equipment (i.e. crank cam) comprising a weight and an universal connecting end. The invention represents a substantial advancement compared to the wheels having a brake as to its safety and operational reliability. The appearance of the crank cam shown in this application resembles a droplet. However, any appearance of the crank cam is possible as long as it may provide the effect of the drop-like crank cam, which is to act as a counterbalance for the rotor of the peristaltic pump.

The invention claimed is:

1. A peristaltic hose pump comprising:

a pump body having a pump cavity;

a rotor configured to compress a hose/tube being positioned on the pump cavity inner perimeter, said rotor being coupled to one end of a crankshaft of the pump body; and an equipment for rotating the rotor manually, wherein the equipment is a rotatable counterbalance and is removably connectable by a connection point to the other end of the crankshaft of the pump body, wherein said rotor is configured to be rotated by the equipment from a position to another position and to maintain said another position by the equipment, and wherein the connection point is an opening configured to be connectable to crankshaft ends of various sizes, the equipment comprising a pin for tightening the connection between the connection point and the other end of the crankshaft of the peristaltic pump, the pin being configured to directly contact the other end of the crankshaft within the connection point to tighten the connection between the connection point and the other end of the crankshaft.

2. The peristaltic hose pump according to claim 1, wherein the equipment further comprises a handle.

3. The peristaltic hose pump according to claim 1, wherein the crankshaft is arranged horizontally, and the equipment connected to the other end of the crankshaft acts as the rotatable counterbalance to counter the weight of the rotor coupled to the one end of the crankshaft.

4. An equipment for rotating a rotor of a peristaltic hose pump, the rotor being coupled to one end of a crankshaft of a pump body of the peristaltic hose pump, wherein the equipment comprises:

a connection point in the form of an opening configured to connect the equipment to the other end of the crankshaft of the pump body, wherein the equipment is a removable and rotatable counterbalance being configured to rotate said rotor from a position to another position and to maintain said another position of the rotor, and the connection point is configured to be connectable to crankshaft ends of various sizes, the equipment comprising a pin for tightening the connection between the connection point and the other end of the crankshaft of the peristaltic pump, the pin being configured to directly contact the other end of the crankshaft within the connection point to tighten the connection between the connection point and the other end of the crankshaft.

5. The equipment according to claim 4, wherein the connection point with the pin is configured to receive and tighten different kinds of crankshaft ends having a diameter less than the diameter of the connection point.

6. The equipment according to claim 4, further comprising a handle.

7. The equipment according to claim 4, wherein the equipment is configured to connect to the other end of a horizontal crankshaft and act as the rotatable counterbalance to counter the weight of the rotor coupled to the one end of the horizontal crankshaft.

* * * * *